United States Patent [19]

Bouchard

[11] Patent Number: 4,534,463

[45] Date of Patent: Aug. 13, 1985

[54] CIGARETTE CARTON

[75] Inventor: Claude Bouchard, St. Leonard, Canada

[73] Assignee: Ronalds-Federated Limited, Rolph-Clark-Stone Packaging Division, Mississauga, Canada

[21] Appl. No.: 554,894

[22] Filed: Nov. 25, 1983

[51] Int. Cl.[3] ..... B65D 5/38

[52] U.S. Cl. ..... 206/267; 206/273; 229/9; 229/19

[58] Field of Search ..... 206/249, 250, 256, 267, 206/271-273; 229/9-11, 19, 20; 312/348, 330 SM

[56] References Cited

U.S. PATENT DOCUMENTS

| | | | |
|---|---|---|---|
| 1,760,678 | 5/1930 | Amatel | 229/9 |
| 2,353,376 | 7/1944 | Vatter | 229/9 |
| 2,358,502 | 9/1944 | Gilbert | 229/20 |
| 2,426,856 | 9/1947 | Berg | 229/11 |
| 2,426,911 | 9/1947 | Williamson | 229/20 |
| 2,581,944 | 1/1952 | Donnell | 229/19 |
| 3,127,083 | 3/1964 | Guyer | 229/11 |
| 3,302,844 | 2/1967 | Henry | 229/10 |
| 3,389,847 | 6/1968 | Darot | 229/9 |
| 4,050,622 | 9/1977 | Shimada et al. | 229/19 |

FOREIGN PATENT DOCUMENTS

| | | | |
|---|---|---|---|
| 0732939 | 4/1966 | Canada | 229/11 |
| 1063526 | 8/1959 | Fed. Rep. of Germany | 229/20 |
| 0890434 | 2/1944 | France | 229/9 |

*Primary Examiner*—George E. Lowrance
*Assistant Examiner*—Jimmy G. Foster
*Attorney, Agent, or Firm*—Bachman and LaPointe

[57] ABSTRACT

A container, especially a paper board container, for cigarettes includes an open ended rectangular casing member and a rectangular, tubular drawer member adapted to be slidably received in the casing member; cooperating means on the drawer and casing members limit sliding movement of the drawer member out of the casing member.

6 Claims, 5 Drawing Figures

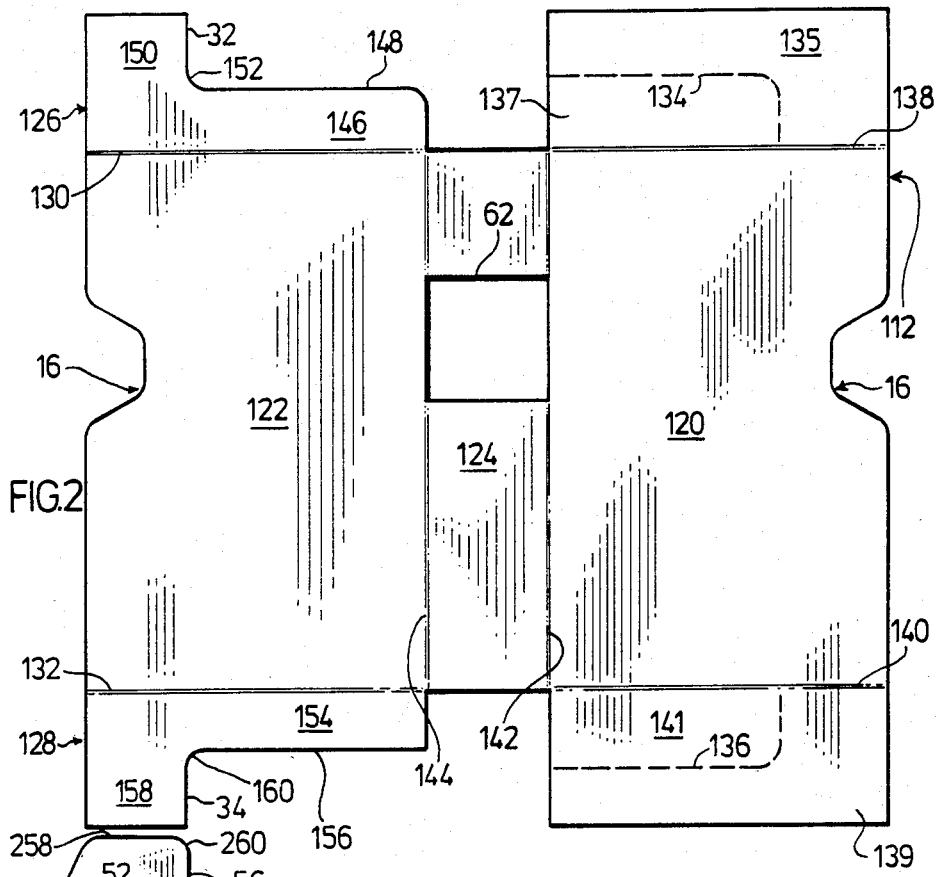
FIG.2
FIG. 3.
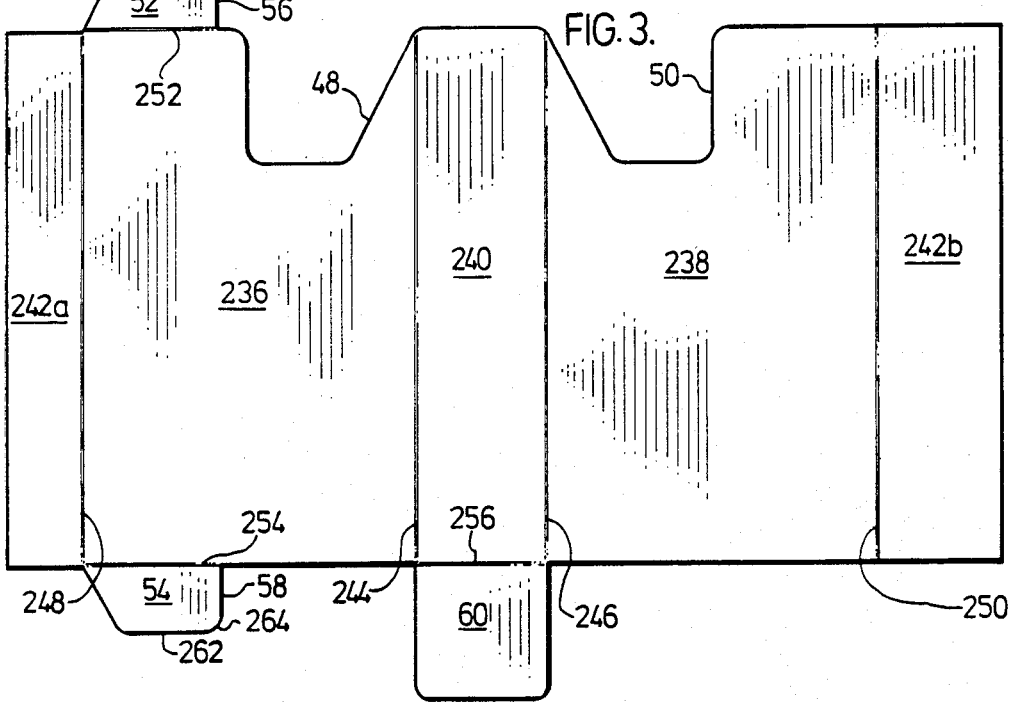

CIGARETTE CARTON

BACKGROUND OF THE INVENTION (i) Field of the Invention

This invention relates to a container, more especially a container for cigarettes and the like, and a blank therefor.

(ii) Description of Prior Art

Cigarettes are conventionally packaged in a container or package of soft paper, a so-called soft pack, or in a container or package of a harder, semi-stiff paper or paper board, a so-called hard pack.

Various attempts have been made to simplify the case with which cigarettes can be withdrawn or dispensed by such containers, for example, as shown in U.S. Pat. Nos. 3,130,893; 3,439,797 and 4,240,543.

In designing improved containers it is also important to develop simple structures which do not use large amounts of paper or paper board and which have a minimum of wastage in cutting operations.

Desirably such containers should not require complex cutting and folding operations, or in any event such operations should be minimized.

One conventional cigarette container comprises a drawer member and a casing member; the cigarettes are held in the drawer member which slides inside the casing member. When a cigarette is desired the user draws the drawer member out of the casing member. One problem with this type of container is that the drawer member may, inadvertantly, be completely withdrawn from the casing member, thus requiring the user to reassemble the container and also resulting in possible loss or damage to cigarettes held in the drawer member, or lack of hygiene if damaged or soiled cigarettes are replaced in the drawer member.

This is both annoying and inconvenient for the user.

On the other hand, freedom to slide the drawer member out of the casing member is desirable to permit convenient access to the contents, especially when the container is partially empty.

SUMMARY OF THE INVENTION

It is an object of this invention to provide a container for cigarettes and the like, of the slide drawer type which avoids the problem of inadvertent complete removal of the drawer in use.

It is another object of the invention in one embodiment to provide such a container which nevertheless permits ready access to the contents.

It is yet another object of the invention, in yet another embodiment to provide such a container including means for dispensing the contents.

Another object of the invention is to provide blanks for forming the component parts of a container of the slide drawer type.

Still another object of the invention is to provide a casing member and a drawer member as components of a container of the slide drawer type.

In accordance with the invention there is provided a container for holding a plurality of elongated objects in side-by-side relationship comprising: a slidable, rectangular, tubular drawer member, a rectangular casing member adapted to slidably receive said drawer member and cooperating means on said drawer and casing members to limit sliding movement of said drawer member out of said casing member.

The invention also provides a drawer member and a blank therefor, for the container of the invention.

The invention also provides a casing member and a blank therefor, for the container of the invention.

BRIEF DESCRIPTION OF THE DRAWINGS

The invention is illustrated in particular and preferred embodiments by reference to the accompanying drawings, in which:

FIG. 2 is a view of the blank for forming the casing of the carton shown in FIG. 1;

FIG. 3 shows the blank of the drawer of the carton;

DESCRIPTION OF PREFERRED EMBODIMENTS

Figure 1:
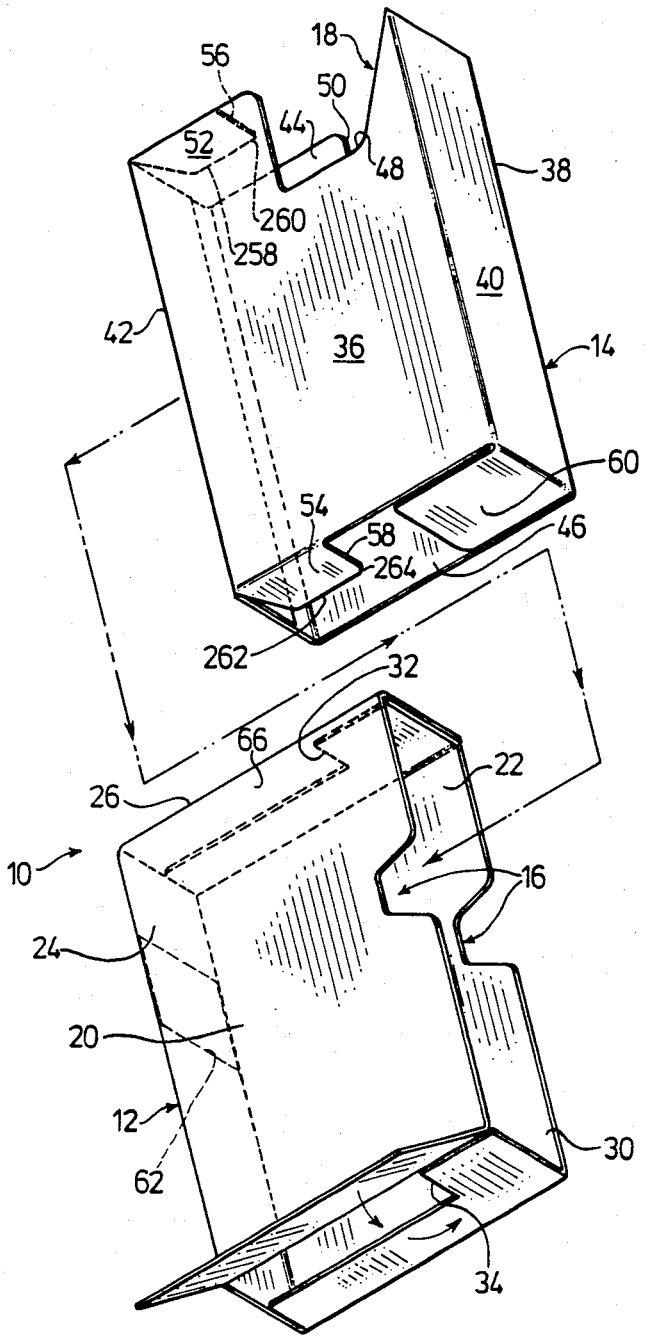
FIG. 1 is a perspective view of a cigarette carton, partially assembled, in accordance with the invention.
Figure 4:
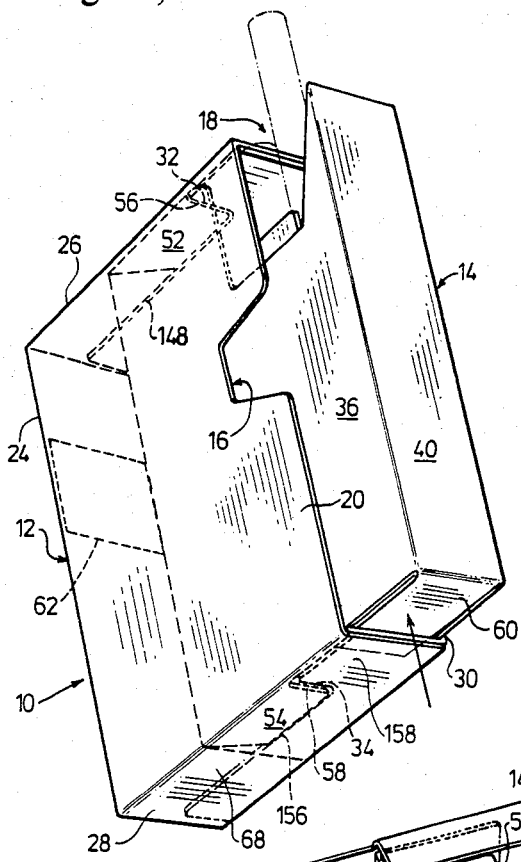
FIG. 4 is a perspective view of the carton of FIG. 1 in the open position.
Figure 5:
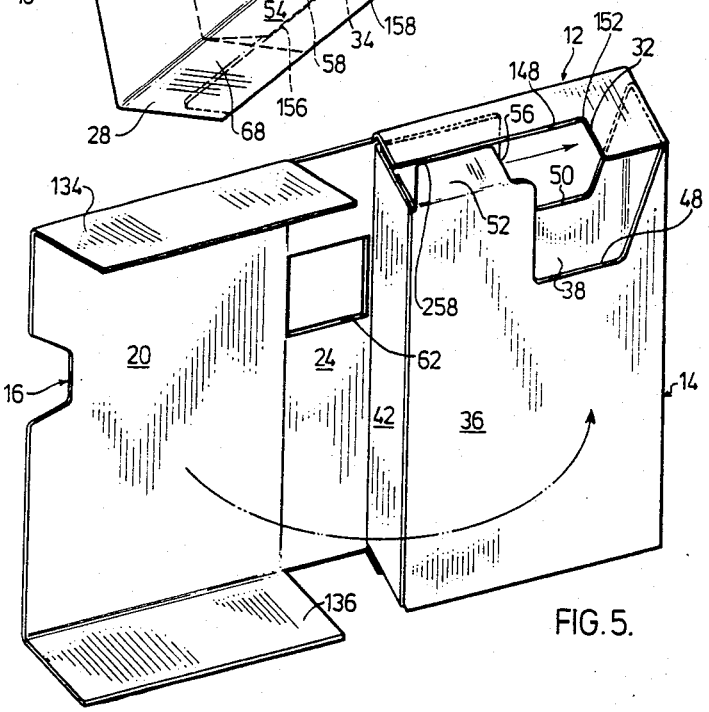
FIG. 5 is a view of the carton of FIG. 1 in the closed position, with the casing partly disassembled.

With reference to FIGS. 1, 4 and 5, a cigarette carton 10 comprises a casing 12 and a drawer 14.

Drawer 14 is slidably received within casing 12 and can slide between a closed position as shown in FIG. 5 wherein drawer 14 is fully contained within casing 12, and an open position as shown in FIG. 4, wherein drawer 14 extends outwardly of casing 12.

Casing 12 includes opposed finger recesses 16 which permit drawer 14 to be held between the fingers for sliding movement.

With further reference to FIGS. 1, 4 and 5, carton 10 includes an access slot 18 in drawer 14 which is exposed when the drawer is in the open position, whereby cigarettes can be readily removed or dispensed, as shown in FIG. 4.

The casing 12 includes a front wall 20, a rear wall 22, an end wall 24, an upper wall 26, a lower wall 28 and an open end 30.

An upper stop edge 32 is formed on the inwardly facing side of upper wall 26 and a lower stop edge 34 is formed on an inwardly facing side of lower wall 28.

A rectangular opening 62 is defined in end wall 24. Opening 62 provides a finger access to facilitate sliding movement of drawer 14.

Thus the carton 10 may be open by pushing end wall 24 through opening 62, while grasping casing 12, so as to slide drawer 14 out of casing 12; or by pulling drawer 14 at opposed finger recesses 16, while grasping casing 12, so as to slide drawer 14 out of casing 12.

The carton 10 may have both rectangular opening 62 and finger recesses 16 or it may have one only of these.

With further reference to FIG. 2, there is shown a blank 112 for forming casing 12. The parts of the blank 112 are identified, as far as possible, employing the same numbers, with the addition of 100, as the parts of the casing 12 which they form. Thus blank 112 forms casing 12.

Blank 112 includes a front wall panel 120, a rear wall panel 122 and an end wall panel 124.

An upper L-shaped panel 126 is connected along a crease and fold line 120 to an upper edge of panel 122.

A lower L-shaped panel 128 is connected along a crease and fold line 132 to a lower edge of panel 122.

An upper rectangular panel 134 is connected along a crease and fold line 138 to an upper edge of panel 120 and a lower rectangular panel 136 is connected along a crease and fold line 140 to a lower edge of panel 120.

Rectangular panel 134 includes zones 135 and 137, and rectangular panel 136 includes similar zones 139 and 141 identified by dotted lines. Zones 135 and 139 are generally L-shaped, mirror images of L-shaped panels 126 and 128 respectively.

Front panel 120 is connected to end panel 124 along a crease and fold line 142, and rear panel 122 is connected to end panel 124 along a crease and fold line 144.

L-shaped panel 126 includes an elongated panel portion 146 defining a slide edge 148, and a tab 150 which defines upper stop edge 32. Slide edge 148 and stop edge 32 meet at a concavely curved corner 152.

L-shaped panel 128 includes an elongated panel portion 154 defining a slide edge 156, and a tab 158 defining lower stop edge 34. Slide edge 156 and stop edge 34 meet at concavely curved corner 160.

The rectangular panels 134 and 136 have a width corresponding to the width of end panel 124. Likewise tabs 150 and 158 of panels 126 and 128 have a length extending from lines 130 and 132 respectively, equal to the width of end panel 124.

With further reference to FIGS. 1, 4 and 5, drawer 14 includes a front wall 36, a rear wall 38, a front end wall 40 and a rear end wall 42.

Drawer 14 has a generally rectangular, tubular configuration with an open top 44 and an open bottom 46. Slots 48 and 50 in walls 36 and 38 respectively define the access slot 18 adjacent end wall 40.

An upper tab 52 extends from an upper edge of front wall 36, adjacent rear end wall 42; and a lower tab 54 extends from a lower end of front wall 36, adjacent rear end wall 42.

Tabs 52 and 54 define leading edges 56 and 58, respectively, facing front end wall 40.

Tab 52 has a slide edge 258 which meets leading edge 56 at a convexly curved corner 260. Similarly tab 54 has a slide edge 262 which meets leading edge 58 at a convexly curved corner 264.

A flip tab 60 extends from a lower edge of front end wall 40.

With further reference to FIG. 3 there is shown a blank 214 for forming drawer 14.

The parts of the blank 214 are identified, as far as possible, employing the same numbers, with the addition of 200, as the parts of the casing 14 which they form. Thus blank 214 forms drawer 14.

Blank 214 includes a front wall panel 236, a rear wall panel 238, a front end wall panel 240 and rear end wall panels **242*a* and 242*b***.

Front panel 236 is connected to front end panel 240 along crease and fold line 244; rear panel 238 is connected to front end panel 240 along crease and fold line 246.

Rear end panel **242*a* is connected to front panel 236 along crease and fold line 248; and rear end panel 242*b* is connected to rear panel 238 along crease and fold line 250**.

Rear end wall panel **242*b* has the same width as front end panel 240 and rear end panel 242*a*** is of lesser width.

Tab 52 is connected to front panel 236 along crease and fold line 252, adjacent panel 242; and tab 54 is connected to front panel 236 along crease and fold line 254, adjacent panel **242*a***.

Flip tab 60 is connected to front end panel 240 along crease and fold line 256.

Flip tab 60 has the same width as front end panel 240.

The assembly of casing 12 and drawer 14, and the assembly of carton 10, therefrom, is described hereinafter.

Casing 12 is formed by folding blank 112 along crease and fold lines 138, 140, 142 and 144.

The L-shaped panels 126 and 128 are folded about their respective crease and fold lines 130 and 132 so as to extend generally perpendicularly from rear wall 20 (formed from rear wall panel 122) towards the upper and lower edges of front walls 20 (formed from rear wall panel 120).

Upper and lower rectangular panels 134 and 136 are folded about their respective crease and fold lines 138 and 140 so as to extend generally perpendicularly of front wall 20 (formed from front wall panel 120), and so as to overlie the folded L-shaped panels 126 and 128.

The outwardly facing surfaces of L-shaped panels 126 and 128 are glued or adhered to the opposed inwardly facing surfaces of rectangular panels 134 and 136, respectively.

More particularly the outwardly facing surface of L-shaped panel 126 is glued or adhered to zone 135 of rectangular panel 134, leaving zone 137 exposed; and the outwardly facing surface of L-shaped panel 128 is glued or adhered to zone 139 of rectangular panel 136, leaving zone 141 exposed.

The zones 135 and 137, and 139 and 141 are identified by dotted lines in the drawings for convenience only and need not be physically defined in anyway in blank 112.

A shallow recess 66 is thus defined in the inwardly facing surface of upper wall 26, having a floor defined by exposed zone 137 and a wall defined by slide edge 148, concavely curved corner 152 and stop edge 32. The depth of recess 66 is thus defined by the thickness of L-shaped panel 126 and thus corresponds to the thickness of the material of blank 112.

A similar shallow recess 68 is defined in the inwardly facing surface of lower wall 28, having a floor defined by exposed zone 141 and a wall defined by slide edge 156, concavely curved corner 160 and stop edge 34.

In assembling drawer 14 from blank 214, the blank 214 is folded along the crease and fold lines 244, 246, 248 and 250 and rear end panel **242*a* is glued or adhered to the inside face of rear end panel 242*b* with the outer edge of panel 242*b* extending along crease and fold line 248**. In this way a rectangular, tubular configuration is formed.

Tabs 52 and 54 are folded along their crease and fold lines 252 and 254 respectively, so as to extend generally perpendicularly of front wall 36 (formed from panel 236) towards rear wall 38 (formed from rear wall panel 238).

Flip tab 60 is folded along crease and fold line 256 so as to extend generally perpendicularly of front end wall 40 (formed from panel 240), towards rear end wall 42 (formed from panels **242*a* and 242*b***).

Drawer 14 is inserted in casing 12 through open end 30, such that in the closed position, when drawer 14 is completely within casing 12, as partly illustrated in FIG. 5, the outer surface of rear end wall 42 of drawer 14 faces the inwardly facing surface of end wall 24 of casing 12. In this position front end wall 40 of drawer 14 is substantially flush with the edge of open end 30 of casing 12.

In the assembled position the tabs 52 and 54 are seated in recesses 66 and 68 respectively, as illustrated in FIGS. 4 and 5.

In the closed position of FIG. 5 the leading edges 56 and 58 of tabs 52 and 54 are spaced inwardly from the stop edges 32 and 34, respectively, of casing 12 at a rear end of recesses 66 and 68; and the slide edges 258 and 262 of drawer 14 are in contact with the slide edges 148 and 156, respectively, of casing 12.

In order to open the carton 10, for removal of a cigarette, the drawer 14 is held between a finger and thumb of, for example, the right hand, at the finger recesses 16, the casing 12 being held in the left hand.

The drawer 14 is pulled by such finger and thumb to slidingly withdraw drawer 14 from casing 12. During such sliding withdrawal, the slide edges 258 and 262 of drawer 14 slide along the slide edges 148 and 156, of the casing 12, respectively.

This sliding movement is continued until leading edges 56 and 58, of tabs 52 and 54, engage stop edges 32 and 34, respectively, in the open position shown in FIG. 2. In this position tabs 52 and 54 are seated in shallow recesses 66 and 68, at a front end thereof, and further sliding movement of drawer 14 outwardly of casing 12 is prevented.

In this open position, illustrated in FIG. 4, the convexly curved corners 260 and 264 of tabs 52 and 54, respectively, mate with the concavely curved corners 152 and 160, respectively of L-shaped panels 126 and 128.

The desired cigarette can then be removed from access slot 18, which is exposed in such open position. If preferred, flip tab 60 can be pushed inwardly of carton 10, so as to raise its free end, whereby a cigarette seated on flip tab 60 is elevated inwardly of access slot 18, and is thereby dispensed.

In the assembled, closed position, flip tab 60 overlies tab 158 and stop edge 34.

In the open position shown in FIG. 4 the free end of flip tab 60 is disposed inwardly of open end 30, and slightly overlies the outer edge of tab 158, so that it is maintained within casing 12.

When the carton 10 is partially empty it may be tilted so that the cigarettes fall towards front end wall 40, for ready removal through slot 18 or dispensing by means of tab 60.

The carton 10 is suitably made of paper board, and it will be understood that the casing 12 and drawer 14 are approximately dimensioned so that drawer 14 may be snugly but slidably received in casing 12, with front and rear walls 36 and 38 of drawer 14 in sliding engagement with front and rear walls 20 and 22 of casing 12.

I claim:

1. A container for cigarettes comprising:

a casing member having first and second side walls, an end wall extending between said side walls, an open end opposed to said end wall, an upper wall extending between upper ends of said side walls, and a lower wall opposed to said upper wall and extending between lower ends of said side walls, a rectangular, tubular drawer member, said drawer member having first and second opposed side walls and first and second opposed end walls extending between said side walls, an access slot defined between said second end wall and said side walls, adjacent said second end wall, said casing member being adapted to slidably receive said drawer member through said open end, and said casing end wall adapted to engage said first end wall of said drawer member to limit inward sliding movement of said drawer member into said casing member, a first shallow recess defined in said upper wall, extending from said casing member end wall and terminating in a first stop edge disposed inwardly of said open end, a second shallow recess defined in said lower wall, extending from said casing member end wall and terminating in a second stop edge disposed inwardly of said open end, a first drawer tab spaced from said drawer member second end wall, extending inwardly from an upper end of said draw member, said first drawer tab having a first tab leading edge, said first tab being slidably contained within said first shallow recess, a second drawer tab spaced from said drawer member second end wall, extending inwardly from a lower end of said drawer member, said second drawer tab having a second tab leading edge, said second tab being slidably contained within said second recess, such that in a closed configuration of the container said first and second leading edges are spaced apart from said first and second stop edges respectively, and said access slot of said drawer member is concealed within said casing, said first and second tabs being slidable within said first and second recesses respectively from said closed configuration to an open configuration in which said first and second leading edges engage said first and second stop edges, respectively, said drawer member projects out of said open end of said casing member and said access slot of said drawer member adjacent said second end wall is revealed.

2. A container according to claim 1, including a flip tab extending from a lower edge of said second end wall, opposed to said access slot.

3. A container according to claim 2, including opposed finger recesses in said first and second casing member side walls, at said open end, to facilitate access to said drawer member for sliding said drawer member from said casing member.

4. A container according to claim 2, including an opening in said end wall, to facilitate access to said drawer member for slidably pushing said drawer member from said casing member.

5. A container according to claim 1, wherein said first recess has a first recess slide edge spaced inwardly from said casing side walls, and said second recess has a second recess slide edge spaced inwardly from said casing side walls, said first drawer tab having a first tab slide edge in sliding engagement with said first recess slide edge, and said second drawer tab having a second tab slide edge in sliding engagement with said second recess slide edge, wherein said first and second tabs are slidably contained within said first and second recesses, respectively for sliding movement of said drawer member in said csing member between said open and closed configurations.

6. A container for cigarettes comprising:

a casing member formed from a folded blank having first and second side walls, an end wall extending between said side walls, an open end opposed to said end wall, an upper wall extending between upper ends of said side walls formed by inner and outer flaps folded in overlapping relationship; a lower wall extending between lower ends of said side walls formed by inner and outer flaps folded in overlapping relationship;

a rectangular, tubular drawer member formed from a folded blank, said drawer member having first and second opposed side walls, and first and second opposed end walls extending between said side walls, an access slot defined between said second end wall and said side walls, adjacent said second end wall, said casing member being adapted to slidably receive said draw member through said open end, and said casing end wall being adapted to engage said first end wall of said drawer member to limit inward sliding movement of said drawer member into said casing member, a cut-out defined in the inner flaps of the upper and lower walls of said casing member, said cutouts defining with said outer flaps first and second shallow recesses in said upper and lower walls, said recesses extending in opposed relationship from said casing member end wall and terminating in first and second stop edges, defined by cut-out edges of said inner flaps, said stop edges being disposed inwardly of said open end, said first and second shallow recesses having first and second recess slide edges respectively defined by cut-out edges of said inner flaps, first and second drawer tabs spaced from said drawer member second end wall, extending inwardly in opposed relationship from upper and lower ends of said drawer member, said tabs having tab slide edges and tab leading edges, said first and second tabs being slidably contained within said first and second recesses respectively, with said tab slide edges in sliding engagement with said recess slide edges, such that in a closed configuration of the container said first and second leading edges are spaced apart from said first and second stop edges respectively, and said access slot of said drawer member is concealed within said casing, said first and second tabs being slidable within said first and second recesses respectively, from said closed configuration to an open configuration in which said first and second leading edges engage said first and second stop edges, respectively, whereby said drawer member projects out of said open end of said casing member and said access slot of said drawer member adjacent said second end wall is revealed.

* * * * *